United States Patent [19]

Archer

[11] 3,934,214

[45] Jan. 20, 1976

[54] SEALED CONTACT HAVING TAPERED REED TIPS

[75] Inventor: Wendel Edward Archer, Gahanna, Ohio

[73] Assignee: Bell Telephone Laboratories, Incorporated, Murray Hill, N.J.

[22] Filed: Mar. 31, 1975

[21] Appl. No.: 563,723

[52] U.S. Cl. ..... 335/154; 335/196
[51] Int. Cl.[2] ..... H01H 51/28
[58] Field of Search ..... 335/151, 152, 153, 154, 335/196

[56] References Cited

UNITED STATES PATENTS

| | | | |
|---|---|---|---|
| 2,927,178 | 3/1960 | Nitsch | 335/154 |
| 3,316,513 | 4/1967 | Bradford | 335/154 |
| 3,678,423 | 7/1972 | Rovnyak | 335/154 |

*Primary Examiner*—Harold Broome
*Attorney, Agent, or Firm*—Richard B. Havill

[57] ABSTRACT

A sealed contact includes a capsule enclosing a pair of magnetic reeds. Each reed has a fixed end sealed in the capsule and a flat movable portion with side edges substantially parallel to one another for a predetermined length and tapered toward one another from the end of the predetermined length to the tip of the movable portion. The reeds are positioned so that the movable portions overlap one another by an overlap length and define an overlap area which is less sensitive to variation in overlap length than a conventional sealed contact having reeds cut substantially normal to the parallel side edges.

3 Claims, 6 Drawing Figures

SEALED CONTACT HAVING TAPERED REED TIPS

BACKGROUND OF THE INVENTION

The invention is a sealed reed contact that is more particularly described as a contact having tapered tip reeds.

A sealed reed contact typically includes a capsule enclosing a pair of magnetic reeds. The reeds are sealed into the capsule so that one end of each reed is fixed, or immobile, and the other end of each reed is free to move. The movable ends of the reeds are positioned to overlap with one another so that they can be moved together for closing a circuit or moved away from each other to open the circuit. Either remanent or non-remanent magnetic material can be used for the reeds.

Because sealed reed contacts are used extensively in telephone switching systems, those contacts occupy a substantial portion of the space allotted for such a system. If the size of the sealed contacts were reduced, considerably space could be saved in all systems installations using a large number of the contacts.

To miniaturize reed contacts, it is desirable to reduce the length of the reeds while retaining the same reed stiffness. This can be accomplished by reducing the thickness of the reed and the diameter of the magnetic wire. Reduction of the diameter decreases the cross-sectional area of the reed, thereby reducing magnetic flux carried by the wire.

An important parameter of operating contacts is the magnetic force of attraction between the two reeds. This force is directly proportional to the square of the magnetic flux and is inversely proportional to the overlap area. In order to retain the closure force of a miniaturized contact at a magnitude equivalent to the magnitude of the larger prior art reed contacts, it is expedient to reduce the overlap area of the miniaturized contact and thereby offset the effect of the reduced flux.

Although reducing the overlap length can reduce the overlap area, the shorter overlap length causes substantial changes in magnetic attraction as a function of variations in the overlap length and misalignment of the reeds.

SUMMARY OF THE INVENTION

It is an object of the invention to miniaturize a magnetic reed contact.

It is another object to develop a magnetic reed contact that is less sensitive to variations of overlap length of the reeds.

It is also an object to develop a magnetic reed contact that is less sensitive to misalignment of the reeds.

These and other objects are realized in an illustrative embodiment of the invention wherein a sealed contact includes a capsule enclosing a pair of magnetic reeds. Each reed has a fixed end sealed in the capsule and a flat movable portion with side edges substantially parallel to one another for a predetermined length and tapered toward one another from the end of the predetermined length to the tip of the movable portion. The reeds are positioned so that the movable portions overlap one another by an overlap length and define an overlap area which is less sensitive to variation in overlap length than a conventional sealed contact having reeds cut perpendicular to the parallel side edges.

In the illustrative embodiment, tapered reed tips overlap one another by an overlap length defining an overlap area which is less sensitive to variation of overlap length than a conventional sealed contact.

It is another aspect of the illustrative embodiment to use a pair of reeds, each shaped so that the overlap area is less sensitive to misalignment of the reeds than a conventional sealed contact.

BRIEF DESCRIPTION OF THE DRAWING

An embodiment of the invention will now be described by way of example, with reference to the attached drawing wherein.

DETAILED DESCRIPTION

Figure 1A:
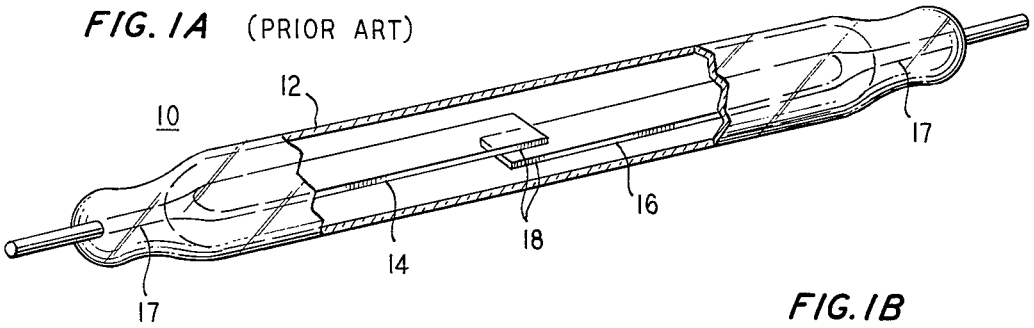
FIG. 1A (PRIOR ART)
FIGS. 1A and 1B show an arrangement of a conventional prior art sealed reed contact and a partial top view of the overlap area of the reeds.

Referring now to FIG. 1A, there is shown a sealed reed contact 10 including a capsule 12 enclosing a pair of magnetiic reeds 14 and 16. The reeds 14 and 16 are sealed into the capsule so that one end 17 of each reed is fixed and the other end 18 is free to move. The ends 18 are a part of flat movable portions having side edges which are substantially parallel to each other. Movable ends 18 overlap each other so that they can be moved together for closing a circuit or moved away from each other to open the circuit. Either remanent or non-remanent magnetic material can be used for the reeds.

Figure 1B:
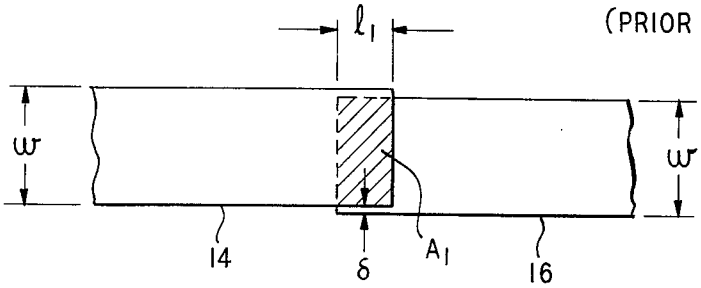
FIG. 1B (PRIOR ART)

FIG. 1B shows a top view of the reeds of FIG. 1A. The reeds 14 and 16 overlap by a length $l_1$ defining a cross-hatched overlap area $A_1$. It is noted that the movable ends 18 are both cut perpendicular, or normal, to the parallel side edges of the reed. Area $A_1$ is a function of the width $w$ and the overlap length $l_1$ together with any change of overlap length, $\Delta l$, and any side to side deviation, or misalignment, $\delta$.

$$\text{Area } A_1 = (w-\delta)(l_1-\Delta l). \quad (1)$$

$$\text{Nominal Area } A_0 = w \cdot l_1, \text{ when } \delta = 0 \text{ and } \Delta l = 0. \quad (2)$$

Variation of Overlap Area $$\frac{\Delta A_1}{A_0} = \frac{w \cdot l_1 - (w-\delta)(l_1-\Delta l)}{w \cdot l_1} \quad (3)$$

$$\frac{\Delta A_1}{A_0} = \frac{\delta \cdot l_1 + w \cdot \Delta l - \delta \cdot \Delta l}{w \cdot l_1} \quad (4)$$

Dimensions and variations resulting from manufacturing processes generally are known in the art. Illustratively, the nominal overlap area $A_0$ is selected to be equal to 1,500 mils$^2$, reed width $w = 50$ mils, and overlap length $l_1 = 30$ mils. The overlap length $l_1$ and the misalignment $\delta$ are subject to random variation resulting from manufacturing processes. Variance of the changes in overlap length, $\Delta l$, is approximately 9 mils, resulting in $\sigma_{\Delta l} = 3$ mils. Variance of misalignment $\delta$ is approximately 4 mils resulting in $\sigma_\delta = 2$ mils. It is believed that variance of $\Delta l$ and $\delta$ are independent. A study of the variations of $\Delta A_1/A_0$, as a function of the distribution of probabilities of $\Delta l$ and $\delta$, follows.

First of all, there is shown a set of tables giving the probabilities for specific variations of $\Delta l$ and $\delta$. Probabilities $P_K(\Delta l) = P(K-1<\Delta l<K)$ for variations of overlap length $\Delta l$, with variance $\sigma_{\Delta l} = 3$ mils and the mean $\overline{\Delta l} = \mu = 0$, are as follows for normal functions:

When $K = 1$, $$P_1(\Delta l) = P(\Delta l = 0.5) = P(0<\Delta l \; a \; 1) = \int_0^1 \Phi(\Delta l)d\Delta l,$$

$$= \int_{-\infty}^{1} \Phi(\Delta l)d\Delta l - \int_{-\infty}^{0} \Phi(\Delta l)d\Delta l, \qquad (5)$$

where $\Phi(\Delta l)$ is a normal function and $d\Delta l$ is the differential of $\Delta l$. The equation (5) can be evaluated by reference to standard tables of values upon calculating $$P(c_1<\Delta l<c_2) = N\left(\frac{c_2-\mu}{\sigma}\right) - N\left(\frac{c_1-\mu}{\sigma}\right) \qquad (6)$$

where $N$ represents a normal function and $c_1$ and $c_2$ are integers from the integration boundaries of equation (5).

Thus $P(0<\Delta l \; a \; 1)$ $= N\left(\frac{1-0}{\sigma\Delta_l}\right) - N\left(\frac{0-0}{\sigma\Delta_l}\right) = N\left(\frac{1-0}{3}\right) - N\left(\frac{0-0}{3}\right)$.

$$= N(1/3) - N(0) \qquad (7)$$

| | |
|---|---|
| $\Delta l = \pm 0.5$ mils | $P_1(\Delta l) = .129$ |
| $\Delta l = \pm 1.5$ mils | $P_2(\Delta l) = .116$ |
| $\Delta l = \pm 2.5$ mils | $P_3(\Delta l) = .096$ |
| $\Delta l = \pm 3.5$ mils | $P_4(\Delta l) = .067$ |
| $\Delta l = \pm 4.5$ mils | $P_5(\Delta l) = .045$ |
| $\Delta l = \pm 5.5$ mils | $P_6(\Delta l) = .024$ |
| $\Delta l = \pm 6.5$ mils | $P_7(\Delta l) = .023$ |

Probabilities $P_J(\delta) = P(J-1<\delta<J)$ for variation of misalignment $\delta$, with $\sigma_\delta = 2$ mils and the mean $\overline{\delta} = \mu = 0$, are as follows for normal functions:

When $J = 1$ $$P_1(\delta) = P(\delta = \pm 0.5) = P(0<\delta<1) = \int_0^1 \Phi(\delta)d\delta$$

$$= \int_{-\infty}^{1} \Phi(\delta)d\delta - \int_{-\infty}^{0} \Phi(\delta)d\delta, \qquad (8)$$

where $\Phi(\delta)$ is a normal function and $d\delta$ is the differential of $\delta$. The equation (8) can be evaluated by reference to standard tables of values upon calculating equation (6).

Thus $P(0<\delta<1)$ $= N\left(\frac{1-0}{\sigma_{\Delta l}}\right) - N\left(\frac{0-0}{\sigma_{\Delta l}}\right) = N\left(\frac{1-0}{2}\right) - N\left(\frac{0-0}{2}\right)$ $$= N(1/2) - N(0) \qquad (9)$$

| | |
|---|---|
| $\delta = \pm 0.5$ mils | $P_1(\delta) = .191$ |
| $\delta = \pm 1.5$ mils | $P_2(\delta) = .162$ |
| $\delta = \pm 2.5$ mils | $P_3(\delta) = .080$ |
| $\delta = \pm 3.5$ mils | $P_4(\delta) = .044$ |
| $\delta = \pm 4.5$ mils | $P_5(\delta) = .017$ |
| $\delta = \pm 5.5$ mils | $P_6(\delta) = .005$ |
| $\delta = \pm 6.5$ mils | $P_7(\delta) = .001$ |

In the foregoing tables of probabilities, values of $\Delta l$ and $\delta$ are representative values in mils of selected sample intervals used for calculating the probabilities of all possible coincident variations of $\Delta l$ and $\delta$. A summation of the resulting probabilities is equal to 1.

$$\text{Thus,} \quad \sum_{K=1}^{7} \sum_{J=1}^{7} P_K(\Delta l)\cdot P_J(\delta) = 1. \qquad (10)$$

For each coincidental combination of $\Delta l$ and $\delta$, there is a corresponding overlap area variation $\Delta A_1$. The probability function of the variation of overlap area, $P_{KJ}(\Delta A_1/A_0)$ is given by $$P_{KJ}(\Delta A_1/A_0) = P_K(\Delta l)\cdot P_J(\delta): \qquad (11)$$

The total probability of occurrence of a particular sample interval of overlap area $P_I(\Delta A_1/A_0)$ is determined by summing $P_{KJ}(\Delta A_1/A_0)$ for all combinations of $\Delta l$ and $\delta$, wherein $\Delta A_1/A_0$ falls within the particular sample interval. The total probability for a particular sample interval of overlap area therefore is given by $$P_I(\Delta A_1/A_0) = \sum_{K=1}^{7} \sum_{J=1}^{7} P_{KJ}(\Delta A_1/A_0) \left| \begin{array}{l}\text{summed for the} \\ \text{particular sample} \\ \text{interval } \Delta A_1/A_0\end{array}\right. \qquad (12)$$

In equation (12) the subscript I designates each sample interval in percent change of area. This subscript integer is at the low end of the sample interval. Thus the probability $P_0(\Delta A_1/A_0)$ represents the probability for the sample interval between zero and 2 percent, and the probability $P_2(\Delta A_1/A_0)$ represents the sample interval between 2 percent and 4 percent.

Information for several discrete sample intervals and for a cumulative distribution function of the variation of overlap area is included in the following table.

| | Probability of Each Possible Percent Variation of Overlap Area $P_I(\Delta A_1/A_0)$ | Cumulative Distribution of Possible Percent Variation of Overlap Area $\sum_{I=0}^{I} P_I(\Delta A_1/A_0)$ |
|---|---|---|
| $P_0(\Delta A_1/A_0)$ | .0723 | .0723 |
| $P_2(\Delta A_1/A_0)$ | .1436 | .2159 |
| $P_4(\Delta A_1/A_0)$ | .1618 | .3777 |
| $P_6(\Delta A_1/A_0)$ | .1000 | .4777 |
| $P_8(\Delta A_1/A_0)$ | .1079 | .5856 |
| $P_{10}(\Delta A_1/A_0)$ | .0978 | .6834 |

-continued

| | | |
|---|---|---|
| $P_{12}(\Delta A_1/A_0)$ | .0803 | .7637 |
| $P_{14}(\Delta A_1/A_0)$ | .0770 | .8407 |
| $P_{16}(\Delta A_1/A_0)$ | .0477 | .8884 |
| $P_{18}(\Delta A_1/A_0)$ | .0326 | .9210 |
| $P_{20}(\Delta A_1/A_0)$ | .0310 | .9520 |
| $P_{22}(\Delta A_1/A_0)$ | .0206 | .9726 |
| $P_{24}(\Delta A_1/A_0)$ | .0141 | .9867 |
| $P_{26}(\Delta A_1/A_0)$ | .0076 | .9943 |
| $P_{28}(\Delta A_1/A_0)$ | .0036 | .9979 |
| $P_{30}(\Delta A_1/A_0)$ | .0006 | .9985 |

Figure 3:
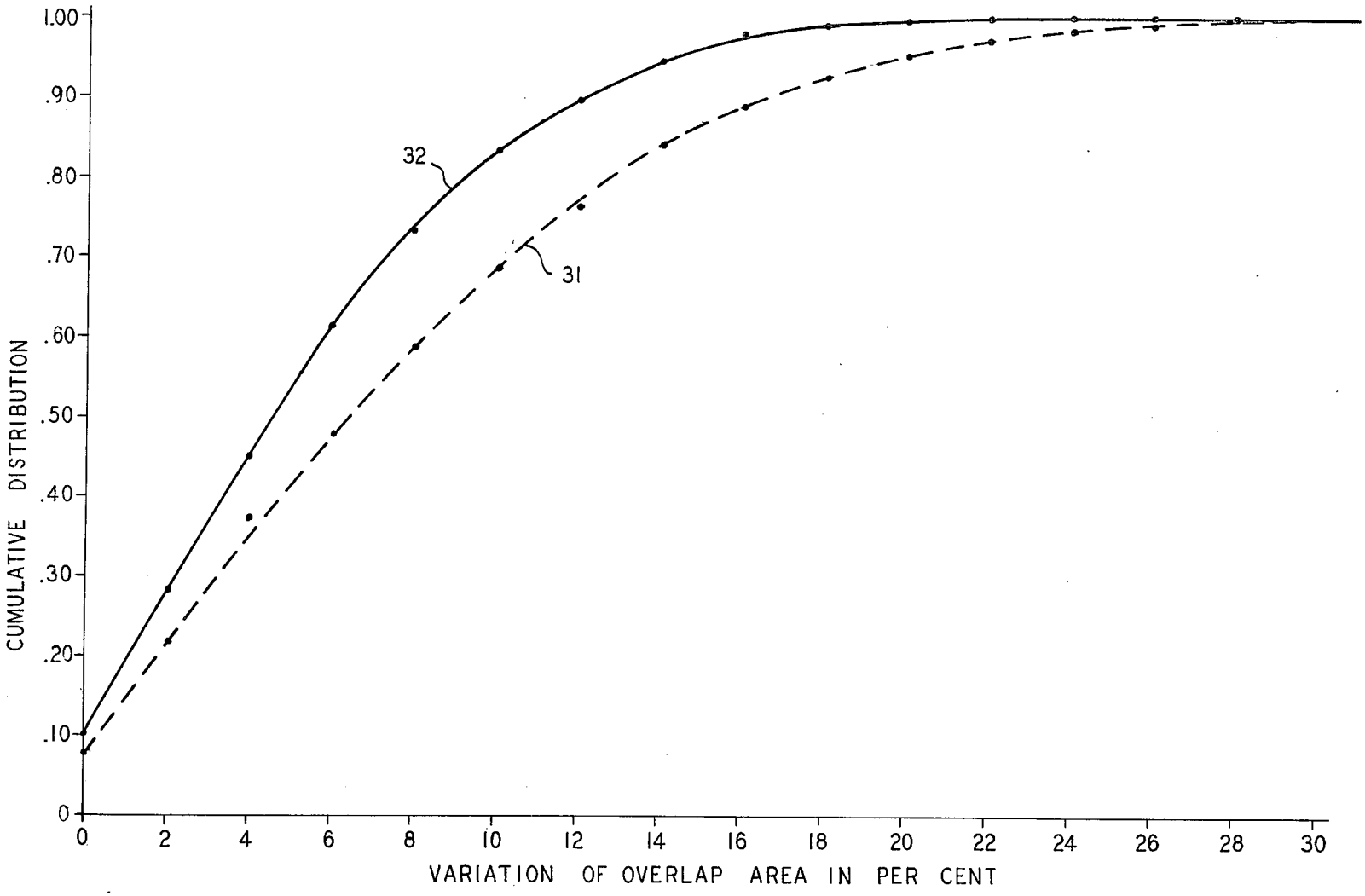
FIG. 3 is a comparative plot of the cumulative distributions of the percent variation of overlap area for FIGS. 1B and 2B.

FIG. 3 includes a curve 31 showing the cumulative distribution of the variation of overlap area $\Delta A_1/A_0$ from the foregoing table. The cumulative distribution is plotted against the variation of area as a percent of nominal area shown as subscripts in the lefthand column of the foregoing table.

Figure 2A:
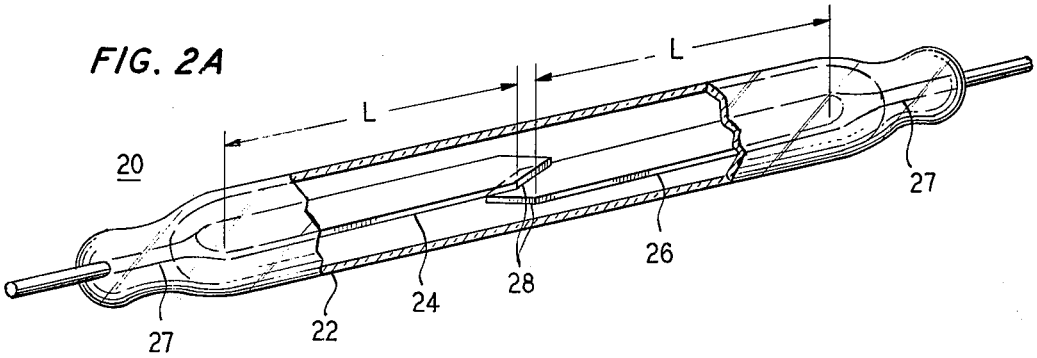
FIG. 2A shows a sealed reed contact.

Referring now to FIG. 2A, there is shown another sealed reed contact 20 including a capsule 22 enclosing a pair of magnetic reeds 24 and 26. The reeds 24 and 26 are sealed into the capsule so that one end 27 of each reed is fixed and the other end 28 is free to move. Movable ends 28 overlap each other so that they can be moved together to close a circuit or moved away from one another to open the circuit. For each reed, the side edges of the movable ends 28 are substantially parallel to one another along a flattened portion for a length $L$. From the end of the length L to the tip of the reed, the sides taper toward one another to a point.

Figure 2B:
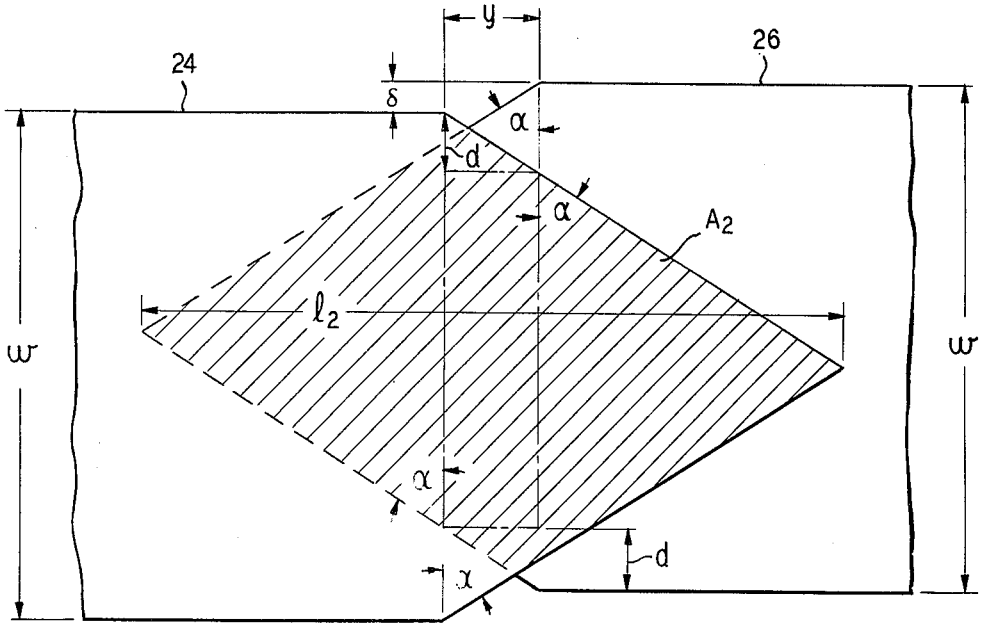
FIG. 2B shows an enlarged top view of the overlap area of the pair of reed contacts of FIG. 2A.

As shown in FIG. 2B, the reeds 24 and 26 are positioned so that the flattened movable portions overlap one another by an overlap length $l_2$ and are positioned so that each of the tapered sides of the two reeds intersects with a tapered side of the other reed. Although FIG. 2B is enlarged to show the cross-hatched overlap area in greater detail, overlap area $A_2$ is nominally equal to the overlap area $A_1$ of the squared-off, or normally cut, tip of the prior art arrangement shown in FIG. 1B and is less sensitive to variation in overlap length $l_2$ than the overlap area $A_1$ is sensitive to the variation of the overlap length $l_1$ of FIG. 1A.

For purposes of comparison of the illustrative embodiment, the width $w$ in FIG. 2B is selected to be equal to 50 mils, the same as the width $w$ in FIG. 1B. Variance of the side to side deviation $\delta$ for the embodiment of FIG. 2B is 4 mils with $\sigma_\delta$ equal to 2, as in the embodiment of FIG. 1B.

Overlap length $l_2$ illustratively is selected to be 72.75 mils so that area $A_2$ nominally equals the area $A_0 =$ 1500 mils$^2$. A distance $y$, which separates the ends of the parallel edges of the reeds, is selected to be slightly longer than three times anticipated standard deviation of the overlap length $l_2$. Since the variation of the overlap length is 9 mils with $\sigma_{\Delta l} = 3$ mils, as in the embodiment of FIG. 1B, the distance $y$ is chosen to be 10 mils.

Area $A_2$ is a function of the width $w$, the overlap length $l_2$, the distance $y$, an offset $d$, any change of the overlap length $\Delta l$, and any side to side deviation, or misalignment $\delta$.

$$A_2 = (w-2d)\frac{(l_2-y)}{2} + (w-2d-\delta)y + [d\cdot y - (d-f)^2\tan\alpha] \quad (13)$$

where $\tan\alpha = y/d = l_2/w$.

For nominal area $A_0 = 1500$ mils$^2$, $w = 50$ mils, $l_2 =$ 72.75 mils, $y = 10$ mils, $\delta = 0$ and $\Delta l = 0$: $d = 6.87$ mils.

The corresponding total probability of occurrence of a particular sample interval of overlap area $P_I(\Delta A_2/A_0)$ is determined by summing $P_{KJ}(\Delta A_2/A_0) = P_K(\Delta l)\cdot P_J(\delta)$ for all combinations of $\Delta l$ and $\delta$ wherein $\Delta A_2/A_0$ falls within the particular sample interval. The total probability for a particular sample interval of overlap area therefore is given by $$P_I(\Delta A_2/A_0) = \sum_{K=1}^{7}\sum_{J=1}^{7} P_{KJ}(\Delta A_2/A_0) \left| \begin{array}{l}\text{summed for the}\\ \text{particular sample}\\ \text{interval } \Delta A_2/A_0\end{array}\right. \quad (14)$$

As in equation (13), the subscript I designates each sample interval in percent change of area. Several sample intervals of information are given together with cumulative distribution information in the following table:

| | Probability of Each Possible Percent Variation of Overlap Area | Cumulative Distribution of Possible Percent Variation of Overlap Area |
|---|---|---|
| | $P_I(\Delta A_2/A_0)$ | $\sum_{I=0}^{I} P_I(\Delta A_2/A_0)$ |
| $P_0\ (\Delta A_2/A_0)$ | .1015 | .1015 |
| $P_2\ (\Delta A_2/A_0)$ | .1852 | .2867 |
| $P_4\ (\Delta A_2/A_0)$ | .1623 | .4490 |
| $P_6\ (\Delta A_2/A_0)$ | .1670 | .6160 |
| $P_8\ (\Delta A_2/A_0)$ | .1144 | .7304 |
| $P_{10}(\Delta A_2/A_0)$ | .1020 | .8324 |
| $P_{12}(\Delta A_2/A_0)$ | .0653 | .8977 |
| $P_{14}(\Delta A_2/A_0)$ | .0452 | .9429 |
| $P_{16}(\Delta A_2/A_0)$ | .0366 | .9795 |
| $P_{18}(\Delta A_2/A_0)$ | .0115 | .9910 |
| $P_{20}(\Delta A_2/A_0)$ | .0050 | .9960 |
| $P_{22}(\Delta A_2/A_0)$ | .0033 | .9993 |
| $P_{24}(\Delta A_2/A_0)$ | .0005 | .9998 |
| $P_{26}(\Delta A_2/A_0)$ | .0001 | .9999 |
| $P_{28}(\Delta A_2/A_0)$ | .0000 | .9999 |
| $P_{30}(\Delta A_2/A_0)$ | .0000 | .9999 |

The foregoing cumulative distribution of variation of overlap area $A_2/A_0$ in percent and its presentation, as curve 32 in FIG. 3, represent the expected frequency of occurrence of variations of $\Delta A_2/A_0$ for the tapered tip reed contact, shown in FIG. 2B.

Curves 31 and 32 of FIG. 3 show that the area $A_2$ of FIG. 2B is less sensitive to variation of overlap length, $\Delta l$, and deviation, $\delta$, than the overlap area $A_1$ of FIG. 1B is sensitive to variation of $\Delta l$ and $\delta$. There is a greater probability of lower percent variations of overlap area $A_2$ than of overlap area $A_1$ throughout the range of interest. In FIG. 3, all of the points where the curve 32 lies above the curve 31 are points at which the overlap area of the tapered tip is less sensitive to variation of overlap length $\Delta l$ and of misalignment $\delta$ than the overlap area of the reeds cut normal to the side edges. The greater probability for lower variation of area shows that more of the possibilities have less variation of overlap area for the tapered tip configuration. This preponderance of lower variations of overlap area resulting from variations of overlap length and deviation provides switch contacts that have more uniform magnetic attraction between reeds during operation.

By extracting only the combinations of $\Delta l$ and $\delta$ wherein $\delta$ is confined within the boundaries $\pm 0.5$ mils, another cumulative distribution is compiled to show that the variation of overlap area of the embodiment of FIGS. 2A and 2B is less sensitive to variation of overlap length than the conventional squared-off tip of FIGS. 1A and 1B.

For each $\Delta l$, there is a corresponding $\Delta A_1$ and $\Delta A_2$. Their probability function has been given previously.

The total probability of overlap variation $\Delta A_1/A_0$ falling within a selected sample interval, $P_T(\Delta A_1/A_0)$, is determined by summing $P_K(\Delta A_1/A_0)$ for all $\Delta l$ wherein the value of $\Delta A_1/A_0$ falls within the selected sample interval.

Thus $$P_T(\Delta A_1/A_0) = \sum_{K=1}^{7} P_K(\Delta A_1/A_0) \Big|_{\substack{\text{summed for the} \\ \text{particular} \\ \text{interval} \\ \Delta A_1/A_0}} \qquad (15)$$

The subscript $T$ designates each sample interval in percent change of area. The following table compiles some sample intervals.

| | Probability of Each Possible Percent Variation of Overlap Area | Cumulative Distribution of Possible Percent Variation of Overlap Area |
|---|---|---|
| | $P_T(\Delta A_1/A_0)$ | $\sum_{T=0}^{T} P_T(\Delta A_1/A_0)$ |
| $P_0$ $(\Delta A_1/A_0)$ | .0645 | .0645 |
| $P_2$ $(\Delta A_1/A_0)$ | .1290 | .1935 |
| $P_4$ $(\Delta A_1/A_0)$ | .2385 | .4320 |
| $P_6$ $(\Delta A_1/A_0)$ | .0480 | .4800 |
| $P_8$ $(\Delta A_1/A_0)$ | .1540 | .6340 |
| $P_{10}(\Delta A_1/A_0)$ | .0815 | .7155 |
| $P_{12}(\Delta A_1/A_0)$ | .0670 | .7825 |
| $P_{14}(\Delta A_1/A_0)$ | .1010 | .8835 |
| $P_{16}(\Delta A_1/A_0)$ | .0120 | .8955 |
| $P_{18}(\Delta A_1/A_0)$ | .0465 | .9420 |
| $P_{20}(\Delta A_1/A_0)$ | .0235 | .9655 |
| $P_{22}(\Delta A_1/A_0)$ | .0230 | .9885 |
| $P_{24}(\Delta A_1/A_0)$ | .0115 | 1.0000 |

The total probability of overlap variation $\Delta A_2/A_0$ falling within a selected sample interval, $P_T(\Delta A_2/A_0)$, is determined by summing $P_K(\Delta A_2/A_0)$ for all $\Delta l$ wherein the value of $\Delta A_2/A_0$ falls within the selected sample interval.

Thus $$P_T = (\Delta A_2/A_0) = \sum_{K=1}^{7} P_K(\Delta A_2/A_0) \Big|_{\substack{\text{summed for the} \\ \text{particular} \\ \text{interval} \\ \Delta A_2/A_0}} \qquad (16)$$

Values are compiled in the following table.

| | Probability of Each Percent Variation of Overlap Area | Cumulative Distribution of Possible Percent Variation of Overlap Area |
|---|---|---|
| | $P_T(\Delta A_2/A_0)$ | $\sum_{T=0}^{T} P_T(\Delta A_2/A_0)$ |
| $P_0$ $(\Delta A_2/A_0)$ | .1290 | .1290 |
| $P_2$ $(\Delta A_2/A_0)$ | .1870 | .3160 |
| $P_4$ $(\Delta A_2/A_0)$ | .1160 | .4320 |
| $P_6$ $(\Delta A_2/A_0)$ | .2020 | .6340 |
| $P_8$ $(\Delta A_2/A_0)$ | .0820 | .7160 |
| $P_{10}(\Delta A_2/A_0)$ | .1000 | .8160 |
| $P_{12}(\Delta A_2/A_0)$ | .0900 | .9060 |
| $P_{14}(\Delta A_2/A_0)$ | .0360 | .9420 |
| $P_{16}(\Delta A_2/A_0)$ | .0350 | .9770 |
| $P_{18}(\Delta A_2/A_0)$ | .0230 | 1.0000 |

Figure 4:
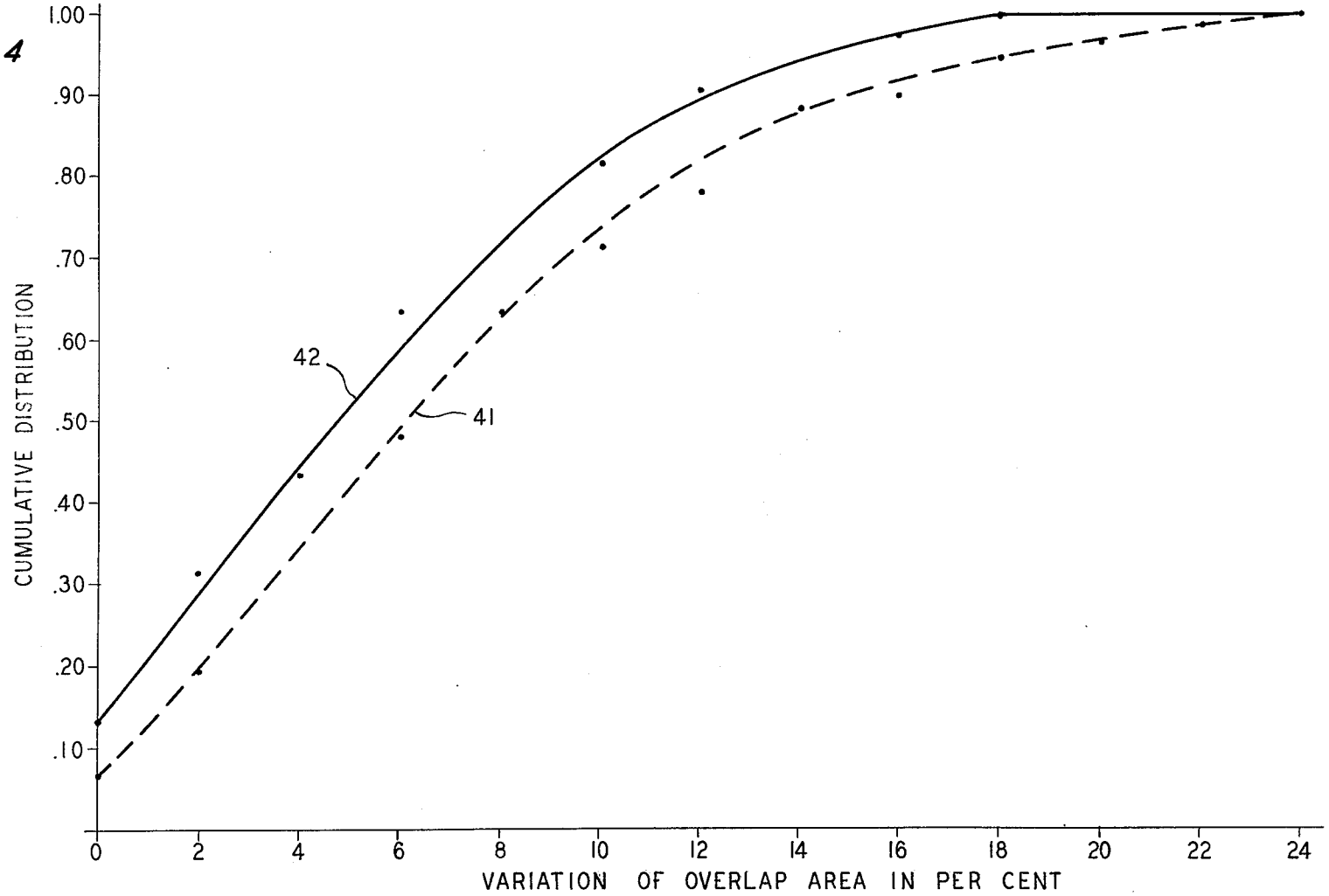
FIG. 4 is a comparative plot of the cumulative distributions of the percent variation of overlap area for FIGS. 1B and 2B when deviation from side to side is minimal.

FIG. 4 includes curves 41 and 42 showing respectively the cumulative distribution of the variation of overlap areas $\Delta A_1/A_0$ and $\Delta A_2/A_0$ from the foregoing tables. Curves 41 and 42 of FIG. 4 show that the area $A_2$ of FIG. 2B is less sensitive to variation of overlap length, $\Delta l$, than the overlap area $A_1$ of FIG. 1B is sensitive to variation of $\Delta l$. In FIG. 4, all of the points where the curve 42 lies above the curve 41 are points at which the overlap area of the tapered tip is less sensitive to variation of overlap length, $\Delta l$, than the overlap area of reeds cut normal to the side edges. This preponderance of lower variations of overlap area resulting from variations of overlap length provides switch contacts that have more nearly uniform magnetic attraction between reeds during operation.

The foregoing detailed description is illustrative of two embodiments of the invention and it is to be understood that additional embodiments thereof will be obvious to those skilled in the art. The embodiments described herein, together with those additional embodiments, are considered to be within the scope of the invention.

What is claimed is:

1. A magnetic reed contact comprising, a capsule, a pair of magnetic reeds, each reed having a fixed end sealed in the capsule and a flat movable end portion with side edges substantially parallel to one another for a predetermined length and tapered toward one another from the end of the predetermined length to the movable end, the reeds are positioned with respect to one another so that the movable ends overlap one another by an overlap length and define an overlap area, and the overlap area is less sensitive to variation in overlap length than the overlap area of a conventional reed contact having reeds cut substantially normal to the parallel side edges.

2. A contact in accordance with claim 1 wherein the magnetic reeds are tapered to a point.

3. A contact in accordance with claim 1 wherein the overlap area is less sensitive to misalignment of the reeds than the overlap area of a conventional reed contact having reeds cut substantially normal to the parallel side edges.

* * * * *

UNITED STATES PATENT AND TRADEMARK OFFICE

CERTIFICATE OF CORRECTION

PATENT NO. : 3,934,214

DATED : January 20, 1976

INVENTOR(S) : Wendel E. Archer

It is certified that error appears in the above-identified patent and that said Letters Patent are hereby corrected as shown below:

Column 1, line 22, "considerably" should read --considerable--. Column 2, line 30, "magnetiic" should read --magnetic--; line 65, "9 mils" should read --9 mils$^2$--; line 66, after "resulting in" the rest of the sentence should read --standard deviation $\sigma_{\Delta\ell}$ = 3 mils--; line 67, "4 mils" should read --4 mils$^2$--, after "resulting in" the rest of the sentence should read --standard deviation $\sigma_\delta$ = 2 mils--. Column 3, line 6, "variance" should read --standard deviation--; lines 11-15, equation (5) should read $$-- \; P_1(\Delta\ell) = P(\Delta\ell=\pm 0.5) = P(0<\Delta\ell<1) = \int_0^1 \Phi(\Delta\ell)d\Delta\ell$$

$$= \int_{-\infty}^{1} \Phi(\Delta\ell)d\Delta\ell - \int_{-\infty}^{1} \Phi(\Delta\ell)d\Delta\ell \; ; \qquad (5) \; --;$$

lines 28-30, equation (7) should read $$-- \text{ Thus } P(0<\Delta\ell<1) = N\left(\frac{1-0}{\sigma_{\Delta\ell}}\right) - N\left(\frac{0-0}{\sigma_{\Delta\ell}}\right) = N\left(\frac{1-0}{3}\right) - N\left(\frac{0-0}{3}\right)$$

$$= N(1/3) - N(0) \qquad (7) \; --$$

UNITED STATES PATENT AND TRADEMARK OFFICE

CERTIFICATE OF CORRECTION

PATENT NO. : 3,934,214

DATED : January 20, 1976

INVENTOR(S) : Wendel E. Archer

It is certified that error appears in the above-identified patent and that said Letters Patent are hereby corrected as shown below:

and lines 32-38, the list of values should read as follows:

-- $\Delta\ell = \pm 0.5$ $\quad P_1(\Delta\ell) = .129$ $\Delta\ell = \pm 1.5$ $\quad P_2(\Delta\ell) = .116$ $\Delta\ell = \pm 2.5$ $\quad P_3(\Delta\ell) = .096$ $\Delta\ell = \pm 3.5$ $\quad P_4(\Delta\ell) = .067$ $\Delta\ell = \pm 4.5$ $\quad P_5(\Delta\ell) = .045$ $\Delta\ell = \pm 5.5$ $\quad P_6(\Delta\ell) = .024$ $\Delta\ell = \pm 6.5$ $\quad P_7(\Delta\ell) = .023$ --.

Column 3, lines 55-56, equation (9) should read as follows:

-- Thus $P(0<\delta<1) = N\left(\frac{1-0}{\sigma_\delta}\right) - N\left(\frac{0-0}{\sigma_\delta}\right) = N\left(\frac{1-0}{2}\right) - N\left(\frac{0-0}{2}\right)$ $$= N(1/2) - N(0) \qquad (9)$$ --.

UNITED STATES PATENT AND TRADEMARK OFFICE

CERTIFICATE OF CORRECTION

PATENT NO. : 3,934,214

DATED : January 20, 1976 Page 3 of 3

INVENTOR(S) : Wendel E. Archer

It is certified that error appears in the above-identified patent and that said Letters Patent are hereby corrected as shown below:

Column 4, lines 5-7, equation (10) should read as follows:

-- Thus, $$\sum_{K=1}^{7} \sum_{J=1}^{7} P_K(\Delta\ell)\cdot P_J(\delta) = 1 \,. \qquad (10)$$ --.

Column 5, line 45, "4 mils with $\sigma_\delta$ equal to 2" should read --4 mils$^2$ with standard deviation $\sigma_\delta$ equal to 2 mils--; line 52, "variation" should read --variance--; line 53, "9 mils" should read --9 mils$^2$--, after "with" insert --standard deviation--; line 62, equation (13) should read as follows:

-- $$A_2 = (w-2d)\frac{(\ell_2-y)}{2} + (w-2d-\delta)y + [d\cdot y-(d-\delta)^2\tan\alpha] \qquad (13)$$ --.

Column 6, lines 10-12, equation (14) should read

-- $$P_I(\Delta A_2/A_0) = \sum_{K=1}^{7} \sum_{J=1}^{7} P_{KJ}(\Delta A_2/A_0) \qquad (14)$$ --.

summed for the particular sample interval $\Delta A_2/A_0$

Signed and Sealed this

Thirty-first Day of May 1977

[SEAL]

*Attest:*

RUTH C. MASON
*Attesting Officer*

C. MARSHALL DANN
*Commissioner of Patents and Trademarks*

Disclaimer 3,934,214.—*Wendel Edward Archer*, Gahanna, Ohio. SEALED CONTACT HAVING TAPERED REED TIPS. Patent dated Jan. 20, 1976. Disclaimer filed Nov. 26, 1980, by the assignee, *Bell Telephone Laboratories, Incorporated.*

Hereby enters this disclaimer to all claims of said patent.

[*Official Gazette February 10, 1981* ]